United States Patent [19]

Miyahara

[11] 4,386,905

[45] Jun. 7, 1983

[54] LIQUID FUEL GASIFYING BURNER

[75] Inventor: Kingo Miyahara, Tokyo, Japan

[73] Assignee: Dowa Co., Ltd., Tokyo, Japan

[21] Appl. No.: 217,907

[22] Filed: Dec. 18, 1980

[30] Foreign Application Priority Data

Dec. 25, 1979 [JP] Japan ..... 54-168616

[51] Int. Cl.[3] ..... F23D 11/04

[52] U.S. Cl. ..... 431/168; 431/186; 239/214.11; 239/214.17

[58] Field of Search ..... 431/168, 169, 352, 171, 431/186; 239/214.11, 214.15, 214.17, 214.21

[56] References Cited

U.S. PATENT DOCUMENTS

| | | | |
|---|---|---|---|
| 1,997,755 | 4/1935 | Smith | 431/168 |
| 2,086,377 | 7/1937 | Bryan | 431/168 |
| 2,738,837 | 3/1956 | McGillis et al. | 431/168 |
| 3,892,518 | 7/1975 | Miyahara | 431/168 |
| 3,947,230 | 3/1976 | Zetterstrom | 431/168 |
| 4,113,421 | 9/1978 | Miyahara | 431/168 |

*Primary Examiner*—James C. Yeung

*Attorney, Agent, or Firm*—Norbert P. Holler; Charles A. Blank

[57] ABSTRACT

A liquid fuel gasifying burner including an inner gasifying member connected to a rotary gasifying member of the frustoconical shape so that the two members can rotate as a unit. The inner gasifying member is formed with an air port in the central portion of its upper end and open at its lower end, and the rotary gasifying member is closed at its upper end and open at its base and rotatably mounted in a combustion cylinder open at its upper end and formed with an air blowing chamber in the central portion of its bottom. A fuel-air mixture passage is defined between the outer circumferential surface of the inner gasifying member and the inner circumferential surface of the rotary gasifying member, and a liquid fuel spreading surface having a liquid fuel scattering portion at its outer periphery is formed on the upper end of the inner gasifying member. A liquid fuel feed line opens at its forward end close to the liquid fuel spreading surface. The burner has a larger liquid fuel spreading surface, a larger atomized liquid fuel gasifying surface and a longer fuel-air passage than the prior art, to achieve complete combustion by producing a homogeneous mixture of gasified fuel and air. The liquid fuel spreading surface may be stepped.

3 Claims, 2 Drawing Figures

LIQUID FUEL GASIFYING BURNER

BACKGROUND OF THE INVENTION

This invention relates to liquid fuel burners, and more particularly it is concerned with a liquid fuel gasifying burner in which a liquid fuel is first burned in atomized particles at initial stages of combustion and then the atomized liquid fuel is vaporized so that the fuel can be burned in gasified form.

In this type of liquid fuel gasifying burner, the liquid fuel is burned in atomized particles and the atomized liquid fuel is vaporized by the heat of combustion of the atomized liquid fuel into gasified fuel while air is mixed with the gasified fuel to produce a fuel-air mixture which is burned in sustained combustion. In order that the combustion of the gasified fuel may be stabilized and abnormal and incomplete combustion may be avoided, it is essential that the atomization of the liquid fuel and the gasification of the atomized liquid fuel take place satisfactorily and that the gasified fuel be mixed satisfactorily with air to produce a homogenous fuel-air mixture. In the event that the atomization of the liquid fuel and the gasification of the atomized liquid fuel do not take place satisfactorily, the atomized liquid fuel would be incorporated in the fuel-air mixture after the combustion of the atomized liquid fuel has shifted to the combustion of the gasified fuel, thereby rendering the combustion unstable. Thus abnormal combustion or incomplete combustion might occur.

SUMMARY OF THE INVENTION

This invention has been developed for the purpose of obviating the aforesaid disadvantages of the prior art. Accordingly, the invention has as its object the provision of a liquid fuel gasifying burner for burning a liquid fuel in gasified form capable of achieving full gasification of the liquid fuel and prompting the production of a homogeneous mixture of the gasified fuel and air to enable stable combustion to be sustained over a prolonged period of time, thereby avoiding the occurrences of abnormal combustion and incomplete combustion.

The outstanding characteristic of the present invention is that the rotary gasifying member for converting a liquid fuel into atomized particles, gasifying the atomized liquid fuel and producing a mixture of the gasified fuel and air has connected thereto an inner gasifying member formed with an air inlet port in the central portion of its upper end and open at its lower end, to define a fuel-air mixture passage between the outer circumferential surface of the inner gasifing member and the inner circumferential surface of the rotary gasifying member. The inner gasifying member is formed on its upper end with a fuel spreading surface and a fuel scattering portion. By virtue of these featutes, the liquid fuel spreading surface can be increased in area within the rotary gasifying member to achieve full atomization of the liquid fuel, the fuel gasifying surface can also be increased in area and the fuel-air mixture passage can be increased in length, thereby promoting full vaporization of the liquid fuel and producing a homogenous mixture of gasified fuel and air.

Additional and other objects, features and advantages of the invention will become apparent from the description of the embodiments set forth hereinafter when considered in conjunction with the accompanying drawings.

BRIEF DESCRIPTION OF THE DRAWINGS

In FIGS. 1 and 2, similar parts are designated by like reference characters in all the drawings.

DESCRIPTION OF THE PREFERRED EMBODIMENTS

Figure 1:
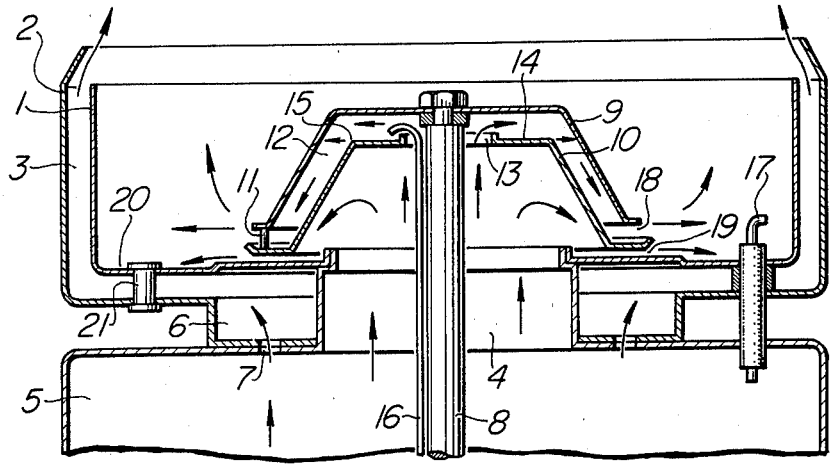
FIG. 1 is a vertical sectional view, with certain parts being cut out, of the liquid fuel gasifying burner comprising one embodiment of the invention.

Referring to FIG. 1, the liquid fuel gasifying burner comprises a combustion cylinder 1 having an open top and a closed bottom, and an outer cylindrical member 2 located outside the combustion cylinder 1 to define therebetween an airflow clearance 3. An air blowing passage 4 is formed in the central portion of the combustion cylinder 1 surrounded by the outer cylindrical member 2 and communicates with an air blowing chamber 5 disposed below the bottom of the outer cylindrical member 2. An air ejecting chamber 6 communicating with the airflow clearance 3 is defined between the combustion cylinder 1 and the outer cylindrical member 2 and surrounds the air blowing passage 4. The air ejecting chamber 6 is maintained in communication with the air blowing chamber 5 through an air inlet port 7.

A rotary shaft 8 extends through the central portion of the combustion cylinder 1 from the air blowing chamber 5 and has secured to its forward end a frustoconical rotary gasifying member 9 having a closed top and an open bottom and disposed in enclosing relation to the rotary shaft 8. An inner gasifying member 10 of substantially the same shape as the frustoconical rotary gasifying member 9 but of a slightly smaller size is secured to the member 9 by a plurality of connectors 11 (three in number in the illustrated embodiment) connecting a flange of the gasifying member 9 at its bottom to a flange of the inner gasifying member 10 at its bottom, so that the two members 9 and 10 can rotate as a unit. A fuel-air mixture passage 12 is defined between the outer circumferential surface of the inner gasifying member 10 and the inner circumferential surface of the rotary gasifying member 9, and an air port 13 is formed substantially in the center of the inner gasifying member 10 which is formed at its upper end with a substantially horizontal liquid fuel spreading surface 14 surrounding the air port 13 and provided with a liquid fuel scattering portion 15 at its outer periphery.

A liquid fuel supply line 16 extends through the air port 13 and has a forward end disposed close to the liquid fuel spreading surface 14. The numeral 17 designates an ignition plug. The fuel-air mixture passage 12 has at its end a fuel-air mixture outlet port 18 opening in a combustion chamber defined in the combustion cylinder 1. The flange at the bottom of the rotary gasifying member 9 and the bottom of the combustion cylinder 1 define therebetween a secondary air outlet port 19. The combustion cylinder 1 is formed at the outer periphery portion of its bottom with a liquid fuel sump 20. The numeral 21 designates connectors for connecting the combustion cylinder 1 to the outer cylindrical member 2 to form the airflow clearance 3 therebetween.

The embodiment of the invention constructed as described hereinabove operates as follows. At burner startup, the rotary gasifying member 9 is rotated at high speed and a current of air is forcedly supplied from the air blowing chamber 5 into the combustion chamber within the combustion cylinder 1 while a liquid fuel is fed through the liquid fuel supply line 16. The liquid fuel flows from the forward end of the liquid fuel supply line 16 on to the liquid fuel spreading surface 14 at the top of the inner gasifying member 10. The liquid fuel thus supplied to the liquid fuel spreading surface 14 is spread on the surface 14 and reaches the liquid fuel scattering portion 15 at the outer peripheral portion of the surface 14 from which the liquid fuel is scattered in atomized particles toward the inner circumferential surface of the rotary gasifying member 9 by centrifugal forces as the rotary gasifying member 9 rotates at high speed. The atomized liquid fuel thus scattered onto the inner circumferential surface of the rotary gasifying member 9 flows along the passage 12 to be discharged from the fuel-air mixture outlet port 18 and scattered along the bottom of the combustion cylinder 1 into the combustion chamber. By actuating the ignition plug 17 at this time, it is possible to start combustion of the atomized liquid fuel mixed with air introduced into the combustion chamber from the air blowing chamber 5 through the passage 12. After the combustion of the atomized liquid fuel is started in the combustion chamber of the combustion cylinder 1, the flames of the combustion heat the rotary gasifying member 9, so that the temperature of the rotary gasifying member 9 quickly reaches the fuel vaporizing point. Because of this, the atomized liquid fuel scattered from the liquid fuel scattering portion 15 of the inner gasifying member 10 toward the inner surface of the rotary gasifying member 9 is vaporized into gasified form upon contact with the inner circumferential surface of the rotary gasifying member 9. The gasified fuel is uniformly mixed with air supplied from the air blowing chamber 5 into the fuel-air mixture passage 12 via the air blowing passage 4 and the air port 13 at the top of the inner gasifying member 10, to produce a mixture of the gasified fuel and air which is discharged into the combustion chamber in the combustion cylinder 1 via the fuel-air mixture outlet port 18, to initiate the combustion of the gasified fuel. After the combustion of the atomized liquid fuel is shifted to the combustion of the gasified fuel, the rotary gasifying member 9 is heated by the flames of the combustion of the gasified fuel and kept at elevated temperatures at all times during burner operation, thereby enabling the combustion of the gasified fuel to be sustained. Secondary air is supplied through the secondary air outlet port 19 into the combustion chamber in the combustion cylinder 1 to enable effective and favorable combustion to be achieved. At the same time, part of the air forcedly fed from the air blowing chamber 5 to the combustion cylinder 1 flows through the air ejecting chamber 6 into the airflow clearance 3 between the combustion cylinder 1 and the outer cylindrical member 2 to avoid overheating and burnout of the combustion cylinder 1 and the outer cylindrical member 2. In the event that unburned excess liquid fuel is present in the combustion cylinder 1 during the combustion of the atomized liquid fuel, the excess liquid fuel collects in the fuel sump 20 formed on the bottom of the combustion cylinder 1 and is vaporized as the temperature in the combustion cylinder 1 rises, thereby enabling abnormal combustion to be avoided during the combustion of the atomized liquid fuel.

The fuel-air mixture passage 12 defined between the rotary gasigying member 9 and the inner gasifying member 10 extends along substantially the entire inner circumferential surface of the rotary gasifying member 9. Thus the area in which the atomized liquid fuel is vaporized into gasified form can be increased and the length of the fuel-air passage 12 from its starting end to the fuel-air mixture outlet port 18 can be increased. Since the fuel-air passage 12 rotated as the rotary gasifying member 9 rotates, the atomized liquid fuel scattered into the fuel-air mixture 12 from the scattering portion 15 is caused to flow in vortical form, so that full vaporization of the atomized liquid fuel and uniform mixing of the gasified fuel with air in the passage 12 can be achieved in a short period of time, to produce a homogenous mixture of the gasified fuel and air. The liquid fuel spreading surface 14 for atomizing the liquid fuel on the upper end of the inner gasifying member 10 is large in area and has at its outer peripheral portion the liquid fuel scattering portion 15, so that fuel atomization of the liquid fuel can be achieved irrespective of the volume of the liquid fuel supplied thereto. Thus the combustion of the atomized liquid fuel can be stabilized, and the vaporization of the atomized liquid fuel in the passage 12 can be promoted by the full atomization of the liquid fuel, so that the production of a homogenous mixture of the gasified fuel and air can be promoted.

Figure 2:
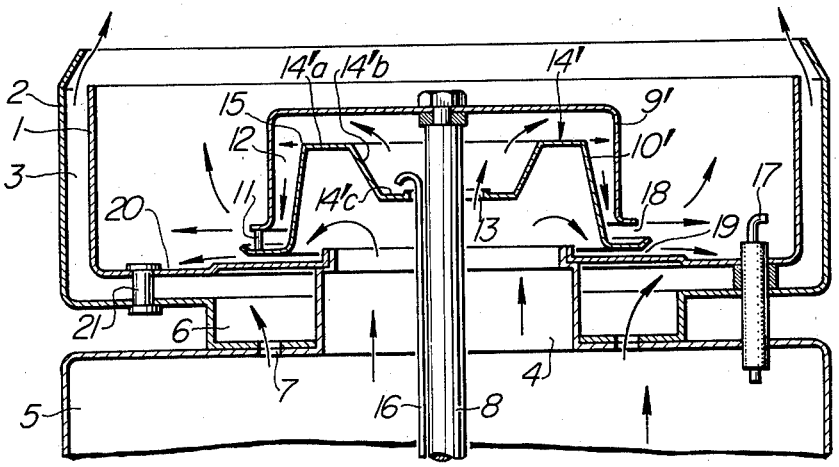
FIG. 2 is a vertical sectional view, with certain parts being cut out, of the liquid fuel gasifying burner comprising another embodiment of the invention.

FIG. 2 shows another embodiment of the invention wherein the horizontal surface at the top of the rotary gasifying member 9' is larger in area than that of the rotary gasifying member 9 shown in FIG. 1, and the liquid fuel spreading surface 14' at the top of the inner gasifying member 10' includes a substantially horizontal spreading surface portion **14'*a*, an inclined surface portion 14'*b* tilting downwardly toward the center of the member 10' and a horizontal liquid fuel receiving surface portion 14'*c* contiguous with the lower end of the inclined surface portion 14'*b*. The embodiment shown in FIG. 2 is similar in other parts to the embodiment shown in FIG. 1. By virture of the aforesaid feature, the burner can be placed in a horizontal position in operation. Further, in the embodiment shown in FIG. 2, the liquid fuel spreading surface 14'** is stepped, and this feature is conducive to promotion of the spreading and atomization of the liquid fuel, so that the combustion of the atomized liquid fuel can be further stabilized and the production of a homogeneous mixture of the gasified fuel and air can be further promoted.

From the foregoing description, it will be appreciated that according to the invention there is provided, in a liquid fuel gasifying burner comprising the combustion cylinder 1 open at its top and having the air blowing chamber 5 in the center of the bottom thereof, and the rotary gasifying member 9 of the frustoconical shape closed at its top and open at its bottom, the inner gasifying member 10 of substantially the same shape as the rotary gasifying member 9 and slightly smaller size formed in the center of its top with the air port 13 and open at its bottom. The inner gasifying member 10 is connected to the rotary gasifying member 9 in enclosed relation so that the two members can rotate as a unit, and the fuel-air passage 12 is defined between the inner circumferential surface of the rotary gasifying member 9 and the outer circumferential surface of the inner gasifying member 10. The inner gasifying member 10 is formed at its top with the liquid fuel spreading surface 14 and the liquid fuel scattering portion 15. Thus the burner according to the invention offers the following advantages. The liquid fuel spreading surface within the rotary gasifying chamber 9 is increased in area to achieve full and smooth atomization of the liquid fuel. The surface on which the atomized liquid fuel is vaporized into gasified form can be increased, and the fuel-air mixture passage 12 can have its length increased, to achieve full vaporization of the atomized liquid fuel and uniform mixing of the gasified fuel with air in the passage 12 while the gasified fuel and air flow in vortical form in the passage 12. Thus the burner is capable of producing a homogenous mixture of the gasified fuel and air and sustaining a stable combustion of the gasified fuel, thereby avoiding abnormal combustion and incomplete combustion.

What is claimed is:

1. A liquid fuel gasifying burner comprising:

a combustion cylinder open at one end and formed with an air blowing chamber in the central portion of the other end;

a rotary gasifying member of the frustoconical shape closed at one end and open at the other end, said rotary gasifying member being rotatably mounted in said combustion cylinder;

a inner gasifying member formed with an air port in the central portion of one end and open at the other end, said inner gasifying member being connected to said rotary gasifying member in enclosed relation so that the two members can rotate as a unit;

a fuel-air mixture passage defined between the inner circumferential surface of said rotary gasifying member and the outer circumferential surface of said inner gasifying member;

a liquid fuel spreading surface formed on said one end of said inner gasifying member; and a liquid fuel scattering portion formed in an outer peripheral portion of said liquid fuel spreading surface.

2. A liquid fuel gasifying burner as claimed in claim 1, wherein at least one portion of said liquid fuel spreading surface is disposed substantially perpendicularly with respect to the center axis of said inner gasifying member.

3. A liquid fuel gasifying burner as claimed in claim 1, wherein a portion of said liquid fuel spreading surface is inclined so that the inclined portion tilts inwardly toward the center axis of said inner cylindrical member.

* * * * *